US005390092A

United States Patent [19]

Lin

[11] Patent Number: 5,390,092

[45] Date of Patent: Feb. 14, 1995

[54] RECEPTACLE APPARATUS FOR LIGHT EMITTING DIODES

[75] Inventor: Sharming Lin, Taipei, Taiwan, Prov. of China

[73] Assignee: Formosa Industrial Computing Inc., Taiwan, Prov. of China

[21] Appl. No.: 252,360

[22] Filed: Jun. 1, 1994

[51] Int. Cl.[6] ..... F21V 17/06

[52] U.S. Cl. ..... 362/235; 362/96; 362/290; 362/433; 362/800

[58] Field of Search ..... 362/235, 249, 290, 342, 362/354, 362, 96, 433, 800

[56] References Cited

U.S. PATENT DOCUMENTS

| | | | |
|---|---|---|---|
| 2,530,361 | 11/1950 | Price | 362/354 |
| 2,540,389 | 2/1951 | Fowler | 362/290 |
| 2,701,298 | 2/1955 | Michailovsky | 362/354 |
| 3,446,955 | 5/1969 | Bailey et al. | 362/290 |
| 3,987,295 | 10/1976 | Veha | 362/96 |
| 5,023,763 | 6/1991 | LeGars | 362/800 |
| 5,036,248 | 7/1991 | McEwan et al. | 362/800 |
| 5,268,828 | 12/1993 | Miura | 362/800 |

*Primary Examiner*—Richard R. Cole
*Attorney, Agent, or Firm*—Parkhurst, Wendel & Rossi

[57] ABSTRACT

A receptacle for light emitting diodes includes a housing defining an opening at one end and having a bottom at another end; a circuit board from which a plurality of light emitting diodes extend being adapted to be received in substantially a middle inner periphery of the housing; a hole being defined in a periphery of the housing; a ridge being longitudinally formed along an inner periphery of the housing; a stop being formed beside the ridge substantially in a same longitudinal level with respect to the hole; a light-resistant device including a ring frame across which a plurality of louvers are connected, a groove defined at an outer periphery of the ring frame, a snapping member being formed on the outer periphery of the ring frame diametrically opposite to the groove; whereby the light-resistant device is positioned at substantially the opening of the housing, with the groove of the light-resistant device receiving the ridge of the housing and the snapping member of the light-resistant device being retained in the hole, a portion of the outer periphery defining the groove abutting against the stop of the housing.

2 Claims, 2 Drawing Sheets

RECEPTACLE APPARATUS FOR LIGHT EMITTING DIODES

BACKGROUND OF THE INVENTION

1. Field of the Invention

The present invention relates to a receptacle apparatus for light emitting diodes, especially one which provides a louvered effect to restrict external light such as sun light from entering therein thus increasing illumination from the light emitting diodes.

2. Description of the Prior Art

LED-type displaying boards are commonly used in the advertising field and each LED-type displaying board comprises a plurality of receptacles each of which comprises a plurality of LEDs installed thereon. FIG. 4 illustrates a conventional LED receptacle which includes a barrel-type housing 50 defining an opening 51 at one end and having a bottom at another end, a circuit board 30 adapted to be received in substantially a middle inner periphery of the barrel-type housing 50, a plurality of LEDs 70 fixed on the circuit board 30. This LED-type displaying board illuminates in a very satisfactory manner if it is positioned in a very dark area. However, if the LED-type displaying board is positioned in a very well-lit background such as outdoors and on a sunny day or in a scoring board where strong illuminating projecting lights are around, the light from the LEDs 70 is relatively weakened, thus reducing the displaying effect. Although the barrel-type housing contributes some light-resistant effect, external light such as sunlight still can project into the housing and strongly decrease the illumination effect from the LEDs. It is requisite to provide a new receptacle for preventing external light from entering the barrel-type housing yet allowing light from the light emitting diodes to emit therethrough.

SUMMARY OF THE INVENTION

The primary objective of the present invention is to provide a receptacle apparatus for light emitting diodes, which can prevent external light from decreasing the illumination effect from the light emitting diodes.

In accordance with one aspect of the invention, there is provided a receptacle for light emitting diodes comprising a barrel-type housing defining an opening at one end and shaving a bottom at another end; a circuit board from which a plurality of light emitting diodes extend being adapted to be received in substantially a middle inner periphery of the barrel-type housing; a hole being defined in a periphery of the barrel-type housing; a ridge being longitudinally formed along an inner periphery of the barrel-type housing; a stop being formed beside the ridge substantially in a same longitudinal level with the hole; a light-resistant device including a ring frame across which a plurality of louvers are connected, a groove defined at an outer periphery of the ring frame, a snapping member being formed on the outer periphery of the ring frame diametrically opposite to the groove; whereby the light-resistant device is positioned at substantially the opening of the housing, with the groove of the light-resistant device receiving the ridge of the housing and the snapping member of the light-resistant device being retained in the hole, a portion of the outer periphery defining the groove abutting against the stop of the barrel-type housing.

DETAILED DESCRIPTION OF THE PREFERRED EMBODIMENT

Figure 1:
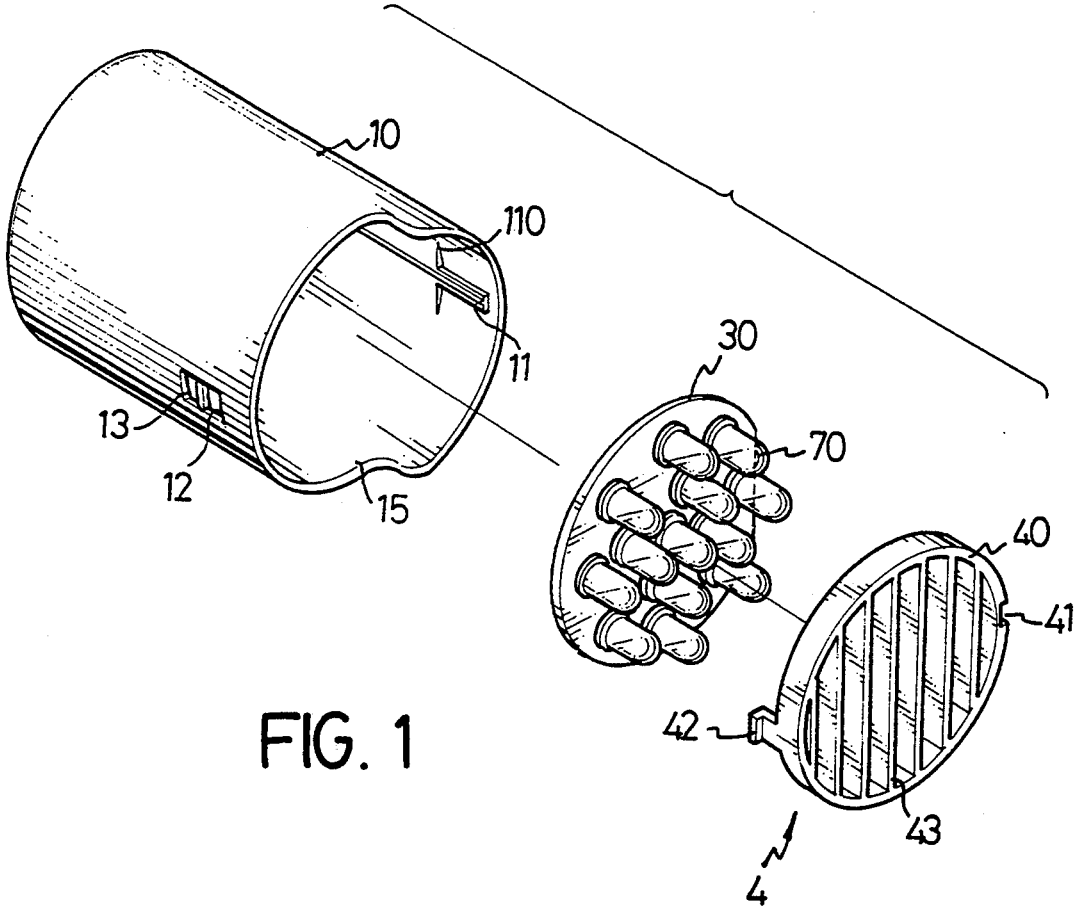
FIG. 1 is an exploded view of an improved receptacle for light emitting diodes.
Figure 3:
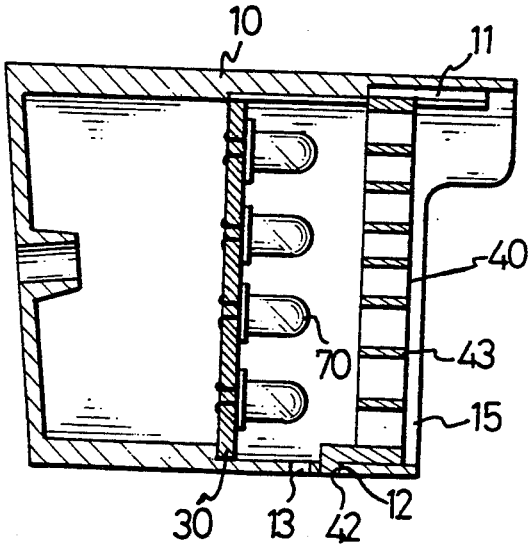
FIG. 3 is a cross-sectional view of the receptacle apparatus of FIG. 2 taken from lines 3—3.
Figure 2:
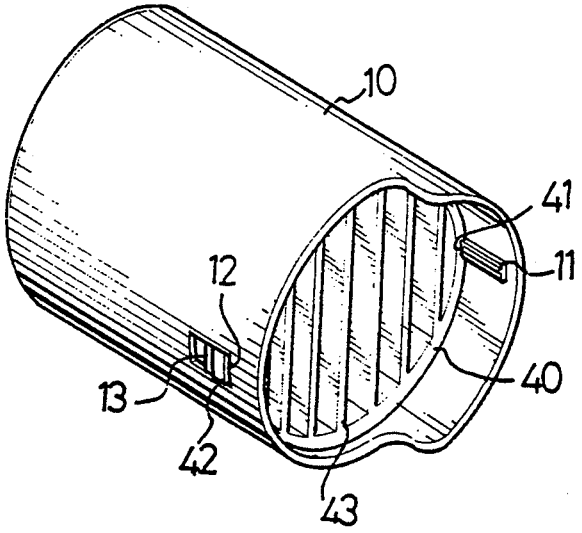
FIG. 2 is an assembled view of FIG. 1.
Figure 4:
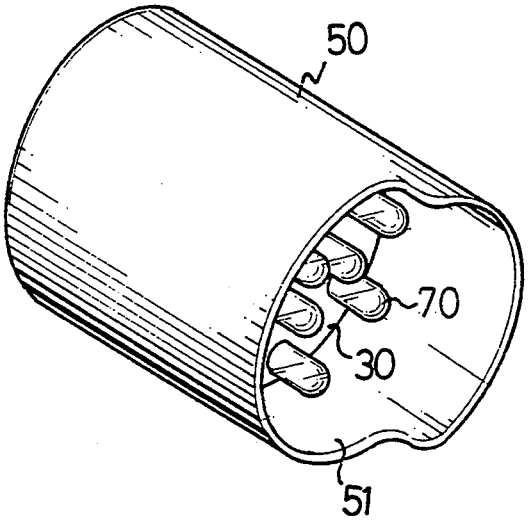
FIG. 4 PRIOR ART
FIG. 4 is a conventional receptacle for light emitting diodes.

Referring to the drawings and initially to FIG. 1, a receptacle for light emitting diodes in accordance with the present invention comprises the conventional receptacle of FIG. 4 and a light-resistant device 4. Similar to the conventional one, the receptacle of the present invention comprises a barrel-type housing 10 defining an opening 15 at one end and having a bottom at another end, a circuit board 30 from which a plurality of light emitting diodes 70 extend being adapted to be received in substantially a middle inner periphery of the barrel-type housing 10. The light emitting diodes 70 are secured to the circuit board 30 by soldering two pins thereto (see FIG. 3). A hole 12 is defined in the periphery of the barrel-type housing 10. A water outlet 13 is defined adjacent to the hole 12 allowing water such as rain water to exit therethrough. A ridge 11 is longitudinally formed along an inner periphery of the barrel-type housing 10. A stop 110 is formed beside the ridge 11 substantially in a same longitudinal level with the hole 12. The circuit board 30 defines a cut out (see dotted lines) preventing it from being obstructed by the ridge 11 and the stop 110 when it is placed in the barrel-type housing 10. The light-resistant device 4 is a ring frame across which a plurality of louvers 43 are connected. A groove 41 is defined at an outer periphery of the ring frame 40. A snapping member 42 is formed on the outer periphery of the ring frame 40 diametrically opposite to the groove 41. Also referring to FIG. 3, the circuit board 30 is positioned in substantially a middle portion of the barrel 10. Also referring to FIG. 2, the ridge 11 is used to guide the groove 41 of the ring frame 40 when the latter is positioned into the housing 10. The light-resistant device 4 is positioned at substantially the opening 15 of the housing 10, with the groove 41 of the light-resistant device 4 receiving the ridge 11 of the housing 10 and the snapping member 42 of the light-resistant device 4 being retained in the hole 12, a portion of the outer periphery defining the groove 41 abutting against the stop 110 of the housing 10. With the light-resistant device 4, sunlight and/or other external light are restricted from entering the housing 10 to diminish illumination from the light emitting diodes 70.

I claim:

1. A receptacle for light emitting diodes comprising a housing defining an opening at one end and having a bottom at another end;

a circuit board from which a plurality of light emitting diodes extend being adapted to be received in substantially a middle inner periphery of the housing;

a hole being defined in a periphery of the housing;

a ridge being longitudinally formed along an inner periphery of the housing;

a stop being formed beside the ridge substantially in a same longitudinal level with the hole;

a light-resistant device including a ring frame across which a plurality of louvers are connected, a groove defined at an outer periphery of the ring frame, a snapping member being formed on the outer periphery of the ring frame diametrically opposite to the groove;

whereby the light-resistant device is positioned at substantially the opening of the housing, with the groove of the light-resistant device receiving the ridge of the housing and the snapping member of the light-resistant device being retained in the hole, a portion of the outer periphery defining the groove abutting against the stop of the housing.

2. A receptacle for light emitting diodes as claimed in claim 1 further comprising a water outlet adjacent to the hole allowing water to exit therethrough.

* * * * *